US005806999A

United States Patent [19]

Kobayashi

[11] Patent Number: 5,806,999

[45] Date of Patent: Sep. 15, 1998

[54] DOUBLE-SIDE PRINTING SYSTEM

[75] Inventor: Takehito Kobayashi, Yamanashi-ken, Japan

[73] Assignee: NISCA Corporation, Yamanashi-ken, Japan

[21] Appl. No.: 550,194

[22] Filed: Oct. 30, 1995

[30] Foreign Application Priority Data

Oct. 28, 1994 [JP] Japan ..... 6-289252

[51] Int. Cl.[6] ..... B41J 3/60

[52] U.S. Cl. ..... 400/188; 400/149; 400/521; 400/542

[58] Field of Search ..... 400/120.01, 120.02, 400/120.04, 120.07, 120.18, 188, 521, 149, 542

[56] References Cited

U.S. PATENT DOCUMENTS

| | | | |
|---|---|---|---|
| 4,738,555 | 4/1988 | Nagashima | 400/240 |
| 5,326,179 | 7/1994 | Fukai et al. | 400/521 |
| 5,401,111 | 3/1995 | Nubson et al. | 400/120.18 |
| 5,486,057 | 1/1996 | Skinner et al. | 400/149 |

OTHER PUBLICATIONS

Japanese Pat. Appln. Pub. No. SHO 55–6331(A) (Corresponds to Japanese Pat. Pub. No. SHO 61–13227 (B)).
Japanese Pat. Appln. Pub. No. SHO 64–90776(A) (Same as JPA Pub. No. HEI 1–90776(A).
Japanese Pat. Appln. Pub. No. HEI 2–4565(A)*.
Japanese Pat. Appln. Pub. No. HEI 5–108894(A)*.

*Primary Examiner*—John S. Hilten
*Attorney, Agent, or Firm*—Kane,Dalsimer,Sullivan, Kurucz, Levy, Eisele and Richard, LLP

[57] ABSTRACT

A double-side printing system has a printer section for printing images on the obverse side of a card, and a turning section for turning over the card sent out from the printer section and sending back the inverted card to the printer section so as to print various images on the reverse side of the card. The printer section performs printing of smooth color gradation images such as photographs with dye-sublimation color inks, and binary gradation images such as bar code patterns and letters with monochromatic thermal wax-transfer ink. The card having its obverse side printed with images is sent to the turning section and turned over 180° so as to print other images on the reverse side of the card.

15 Claims, 8 Drawing Sheets

30
330
336
334
332
C
321a
347d
A
326
326a
347c
326b
324a
324b
325b
325a
324
384
(384a)
326c
352
326d
350
370
362
364
360
382
(382a)
323b
323a
322b
322a
323c
344
345
346
343b
343a
342
341
340

DOUBLE-SIDE PRINTING SYSTEM

BACKGROUND OF THE INVENTION

1. Field of the Invention:

This invention relates to a double-side printing system for printing images on both sides of a record medium, and more particularly to a printing system capable of printing binary gradation images such as letters, characters and bar code patterns and/or smooth color gradation images of continuous-tone photo-quality such as a full-color photograph on both sides of the record medium such as an identity card with a one-side printing unit using monochromatic of thermal wax-transfer ink and dye-sublimation inks of different colors.

2. Description of the Prior Art:

Thermal transfer printers are widely used for printing various personal information data on an identity card (ID card), credit card, IC card and the like.

Of the information data to be printed by the thermal transfer printer of this kind, in general, binary gradation (black-and-white) images such as letters, characters and bar code patterns and printed with usually black thermal wax-transfer ink. Smooth color gradation images such as a full-color photograph can be printed with high reproducibility by using dye-sublimation inks of three primary colors, i.e. yellow, magenta and cyan.

As one possible way of simplifying a printing unit for printing images with the thermal wax-transfer ink and dye-sublimation inks, attempts are being made to apply these inks different in thermal characteristic together onto a long strap of plastic thin film (ribbon base) to form the so-called ink ribbon, as described in, for instance, Japanese Patent Application Publication No. HEI 2(1990)-4565(A).

The aforenoted prior art ink ribbon is formed by applying the inks to the respective frames defined on the ribbon base in order. Use of such a composite ink ribbon coated with the thermal transfer inks of two types in order may be advantageous to print the black-and-white images and the full-color photographic images on the card with a single printing unit. However, in a case that only the black-and-white images such as letters, characters and bar code patterns are printed on the card, it is a waste of ink ribbon as much as 75% because the three frames of dye-sublimation inks of three colors are not used. Besides, the dye-sublimation ink is fairly expensive, and therefore, the utilization of the composite ink ribbon coated with the thermal wax-transfer ink and dye-sublimation inks is not rational nor economical.

Particularly when printing on both sides of the card, two thermal printing units must be disposed one on either side of a card feed passage. Then, by turning over the card 180° after printing one side of the card, only one printing unit suffices for printing on both sides of the card, as described in Japanese Pat. Appln. Publication No. HEI 5(1993)-108894(A).

However, if printing monochromatic images or patterns on the both sides of the card by use of the aforenoted composite ink ribbon, the wastefulness as touched upon above is doubled.

Furthermore, although the aforementioned Japanese Pat. Appln. Publication No. NEI 5(1993)-108894(A) illustrates an idea of turning over the card by use of a rotary body having two pair of card feed rollers for moving a card along a card feed passage, a concrete card turning mechanism is not disclosed in the aforenoted prior art publication. However, no doubt it is impossible for such a simple card turning device to turn over the card without displacing the card from a proper card-holding position.

OBJECT OF THE INVENTION

An object of the present invention is to provide a double-side printing system that enables desired images to be printed on both sides of a card by use of one printer section capable of printing binary gradation images and/or smooth color gradation images of photo-quality together on one side of a record medium in a rational manner.

Another object of this invention is to provide a double-side printing system including one printer section capable of arbitrarily printing desired binary gradation and/or multiple gradation images on one side of a card, and a card turning section capable of stably turning over the card without displacing the card after one side of the card is printed with the printer section, so as to effectively perform printing on both sides of the card.

Still another object of this invention is to provide a double-side printing system having one printer section formed of a first printing assembly for printing binary gradation images such as letters and bar code patterns and a second printing assembly for printing smooth color gradation images such as a full-color photograph, so as to perform printing various images economically and rationally.

Yet another object of this invention is to provide a double-side printing system capable of automatically feeding continuously blank cards to a printer section one by one and performing printing on both sides of the respective cards in succession.

SUMMARY OF THE INVENTION

To accomplish the objects described above according to this invention, there is provided a double-side printing system comprising a printer section formed of a first printing assembly for printing first images with a first ink ribbon on a record medium, and a second printing assembly for printing second images on the record medium with a second ink ribbon, and a turning section for turning over the record medium sent out from the printer section and sending back the inverted record medium to the printer section.

The first printing assembly accommodates a dye-sublimation ink ribbon as the first ink ribbon, which is coated with at least three dye-sublimation inks of different colors, so as to print the first images of multiple gradation or smooth color gradation on the record medium by selectively driving a first thermal print head. The second printing assembly accommodates a thermal wax-transfer ink ribbon so as to print the second images of binary gradation on the record medium by selectively driving a second thermal print head.

The turning section comprises a rotary body including roller units with paired feed rollers, a feed means including a feeding motor and a pulley freely disposed on the rotational axis of the rotary body for transmitting rotational motion of the feeding motor to the feed rollers to move a record medium held between the feed rollers, means for turning the rotary body, and a rotation switch means for selectively transmitting the rotation of the feeding motor to at least one of the feed rollers.

A plurality of cards as the record medium are stacked in a card supply unit disposed at the card intake portion of the printer section and automatically fed one by one from the card supply unit to the printer section.

On the obverse side of the card fed from the card supply unit to the printer section, desired smooth color gradation images such as a full-color photograph are printed with the dye-sublimation inks of three primary colors in the first printing assembly, and then, desired binary gradation images such as letters and bar code patterns are printed with the thermal wax-transfer ink in the second printing assembly.

The card having the images printed on its obverse side is sent out from the printer section to the turning section and turned over 180° there by rotating the rotary body. When the rotary body revolves to turn over the card, the paired feed rollers between which the card is held in position are not rotated by the rotation switch means mounted in rotation transmission route from the feeding motor to the feed rollers, thus preventing the card in rotation from being displaced.

The card thus inverted is sent back to the printer section, so that the reverse side is printed in the same manner. Consequently, the desired images can be printed effectively on the both sides of the card by the rational printing system.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not limitative of the present invention.

Figure 1:
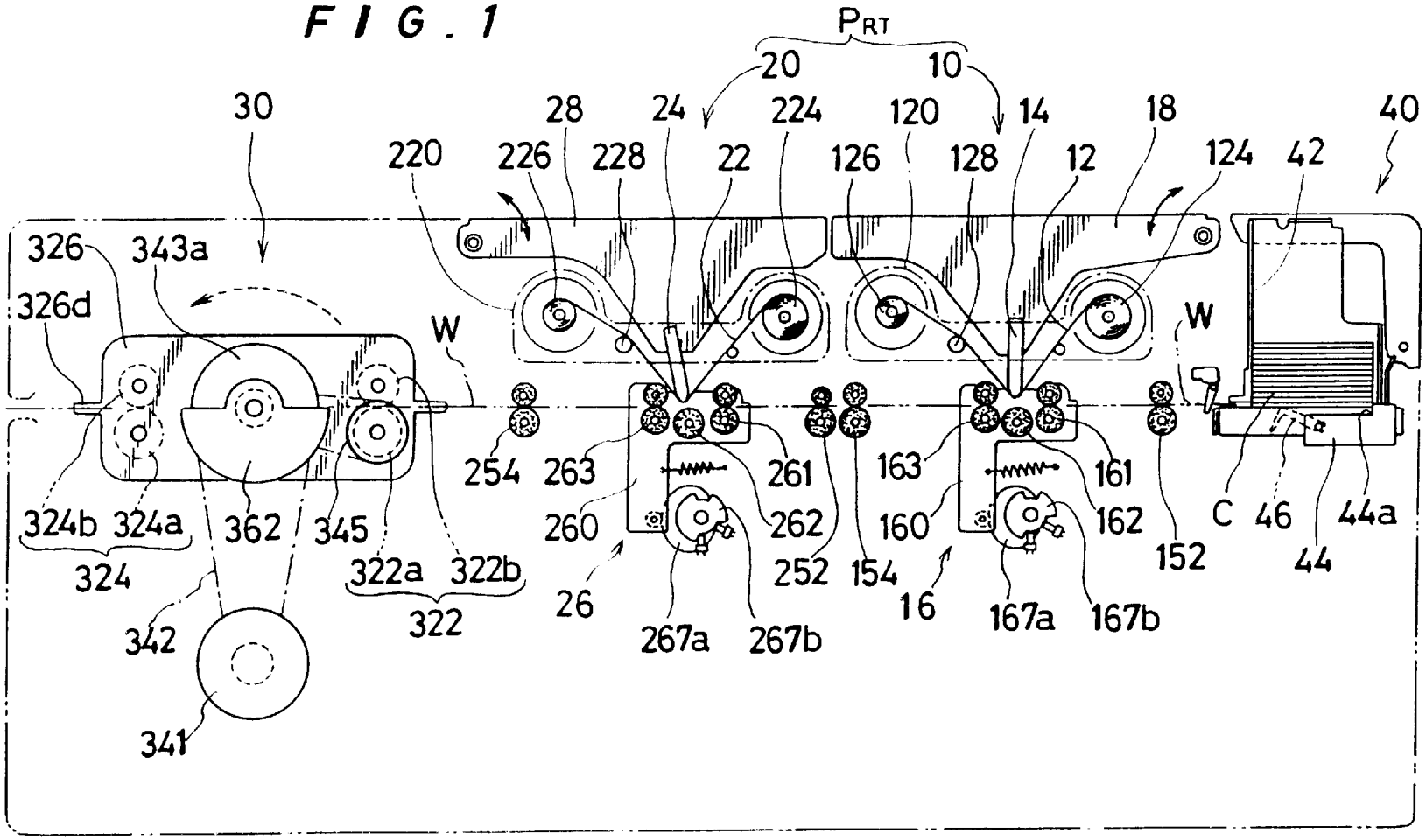
FIG. 1 is a front view schematically showing one embodiment of a double-side printing system of the present invention.
Figure 2:
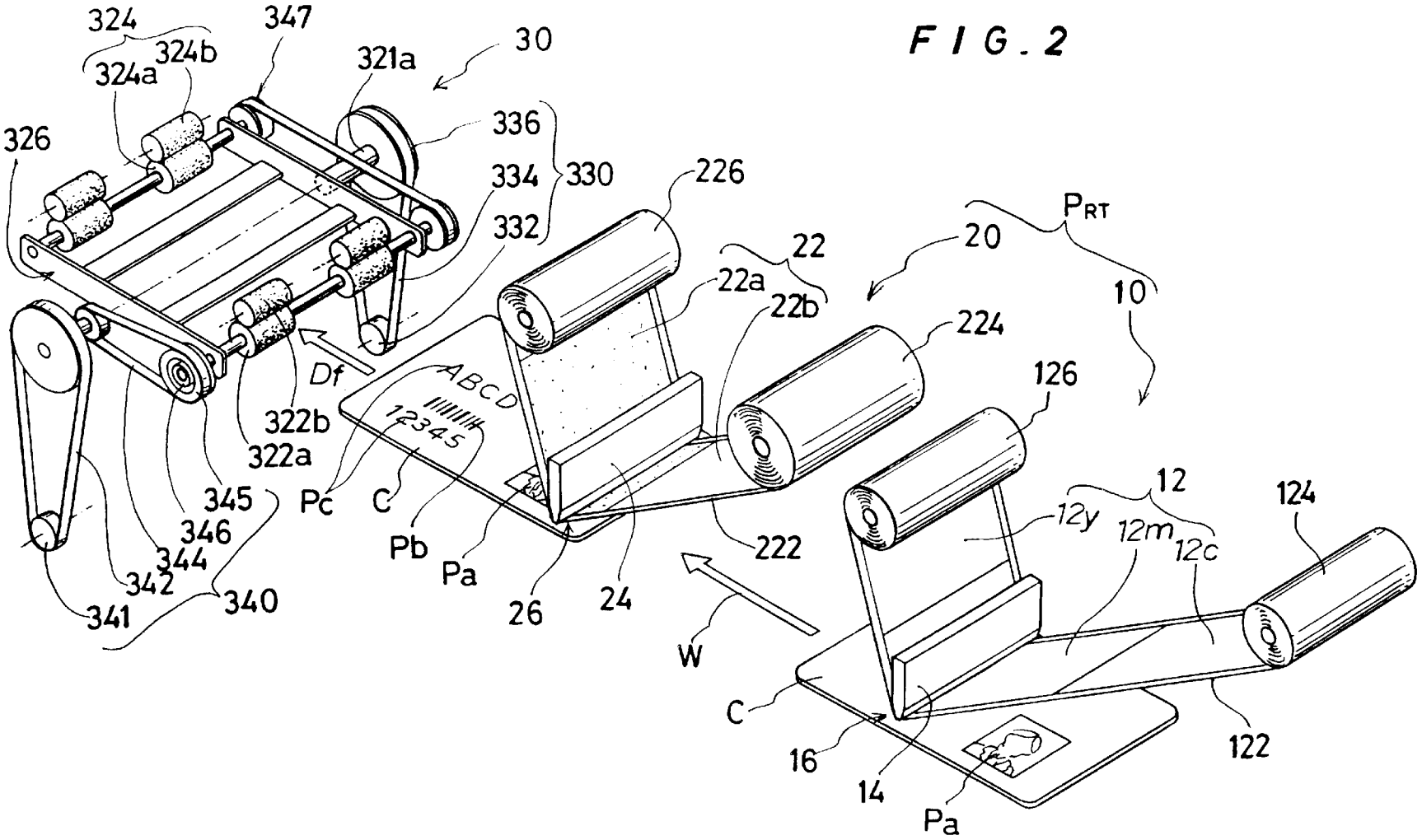
FIG. 2 is a schematic perspective view of FIG. 1.

FIGS. 1 and 2 schematically illustrate one embodiment of the double-side printing system according to this invention, which comprises a printer section $P_{HT}$ having a first printing assembly 10 at a first printing part 16, a second printing assembly 20 at a second printing part 26, a turning section 30, and a card supply unit 40 for supplying blank cards.

The first and second printing assemblies 10 and 20 are placed on one side of a card feed passage W horizontally traversing the printing system.

The first printing assembly 10 serves to print first images of smooth color gradation such as a full-color photograph Pa on a sheet- or card-like record medium C (hereinafter, referred to simply as "card") by use of a first ink ribbon 12 coated with dye-sublimation inks of at least three primary colors, i.e. yellow 12*y*, magenta 12*m* and cyan 12*c*.

The first ink ribbon 12 is formed by repetitively arranging the aforenoted dye-sublimation color inks 12*y*, 12*m* and 12*c* in order on one side of a strip of ribbon base 122. The area occupied by each color ink corresponds to the surface area of the card C to be printed in principle.

The first ink ribbon 12 wound on a supply roll 124 is fed through a first thermal print head 14 and wound on a takeup roll 126. The ink ribbon 12 along with the supply roll 124 and takeup roll 126 is contained in a cartridge 120 which can be detachably seated on the printing part 16 by a simple operation.

In the illustrated embodiment, the first thermal print head 14 is fixed to a cover lid 18 overlaying partially on the upper portion of the printer section $P_{RT}$. By closing the cover lid 18 upon fitting the cartridge 120 into the printing part 16, the first thermal print head 14 is automatically seated at the printing part 16 defined between the supply roll 124 and takeup roll 126 while pressing the first ink ribbon 12 downward. Thus, the thermal print head 14 comes into contact with the card C fed from the card supply unit 40 to the printing part 16 through the ink ribbon 12.

The first ink ribbon 12 and the card C together move in the forward direction at the same speed while pressing the ink ribbon 12 against the card C with the thermal print head 14, and simultaneously, the thermal print head 14 is driven with heating signal currents corresponding to image data based on a given image. Consequently, one of the dye-sublimation color inks 12*y*, 12*m* and 12*c*, which is located in the frame of the ink ribbon opposite to the print head 14 at one time, is sublimated with the heat of the print head 14 to be transferred to the surface of the card C.

Since multiple color printing is performed to produce the desired full-color image Pa on the card C by use of the three color inks 12*y*, 12*m* and 12*c*, the card C must pass through the printing part 16 once every color. That is, the card C transported from the card supply unit 40 to a print-starting point in the printing part 16 is first printed with the first ink 12*y* while moving in the forward direction, and upon completion of printing with the first ink 12*y*, the card C is returned to the print-starting point. Then, the card C thus printed is next printed with the second ink 12*m* over the printed pattern with the first ink 12*y*, and upon completion of printing with the second ink, the card C is again returned to the print-starting point. Finally, the card C thus printed with the first inks 12*y* and 12*m* is further printed with the third ink 12*c*, and upon completion of printing with the third ink, the card C is sent out from the first printing part 16 toward the second printing part 26. As a consequence of multi-color printing, the desired full-color image is produced on the prescribed portion on the card C.

The second printing assembly 20 serves to print second images prepresented in binary gradation such as bar code pattern Pb and characters Pc on the record medium C by use of a second ink ribbon 22 coated with generally black thermal wax-transfer ink 22*a*.

The second printing assembly 20 comprises a second ink ribbon 22 to which the monochrome thermal wax-transfer ink 22*a* and the transparent protective layer 22*b* are applied in a line alternatively as noted above, and a second thermal print head 24 for thermally transferring the thermal wax-transfer ink 22*a* and protective layer 22*b* to the card C. In addition, the second ink ribbon 22 may be optionally provided with a thermally transferable hologram film.

The ink 22*a* and protective layer 22*b* each have the extent substantially equal to the surface area of the card C to be printed.

The second ink ribbon 22 wound on a supply roll 224 is fed through a printing part 26 and wound on a takeup roll 226. The ink ribbon 22 including the supply roll 224 and takeup roll 226 is accommodated in a cartridge 220 which can be detachably fitted into the printing part 26 by a simple operation.

The second thermal print head 24 is fixed to a cover lid 28 partially overlaying on the upper portion of the printer section $P_{RT}$. By closing the cover lid 18 upon setting the cartridge 220 into the second printing part 26, the second thermal print head 24 is automatically situated at the printing part 26 defined between the supply roll 224 and takeup roll 226 while pressing the second ink ribbon 22 downward. Thus, the thermal print head 24 comes into contact with the card C fed from the first printing part 16 to the second printing part 26 through the ink ribbon 22.

The second ink ribbon 22 and the card C together move in the forward direction at the same speed while pressing the ink ribbon 22 against the card C with the thermal print head 24, and simultaneously, the thermal print head 24 is driven with image signal currents. Consequently, the thermal wax-transfer ink 22*a* and protective layer 22*b* are thermally transferred to the card C with the heat of the thermal print head 24.

The thermal wax-transfer ink 22*a* is ordinarily of black suitable for distinctly depicting binary gradation images such as a bar code pattern Pb and characters Pc.

The protective layer 22*b* is generally a plastic thin film and has a function of restraining discoloration of the fugitive dye-sublimation inks printed on the card at the first printing assembly 10.

The second thermal print head 24 is operated at higher temperatures than that for the first thermal print head 14, because, in general, the thermal wax-transfer ink 22*a* for producing the binary gradation images is relatively high in phase transition temperature, wide in range of the phase transition temperature thereof, and tolerant of the heat.

As is plain from the foregoing, because of the differences in specific characteristic between the first and second ink ribbons 12 and 22, these ink ribbons must function under different conditions such as operating temperature and run-off angle at which each ribbon is separated from the card C immediately after transfer printing. Accordingly, the print heads 14 and 24 may be somewhat different in run-off angle as shown in FIG. 1.

The card supply unit 40 comprises a card stacker 42 in which the blank cards C are stacked. On the bottom of the card stacker 32, there is mounted a slide carrier 44 having a catch 34*a* for hooking the rear end of the lowermost of the cards stacked in the stacker 42. The carrier 44 is slidably moved to thrust out the lowermost card toward the first printing part 16. Thus, the blank cards C stacked in the card supply unit 40 can be continuously fed one by one to the printer section $P_{RT}$.

In the drawing, reference numeral 46 denotes a card empty sensor for detecting the card existing in the card stacker 42.

Figure 3:
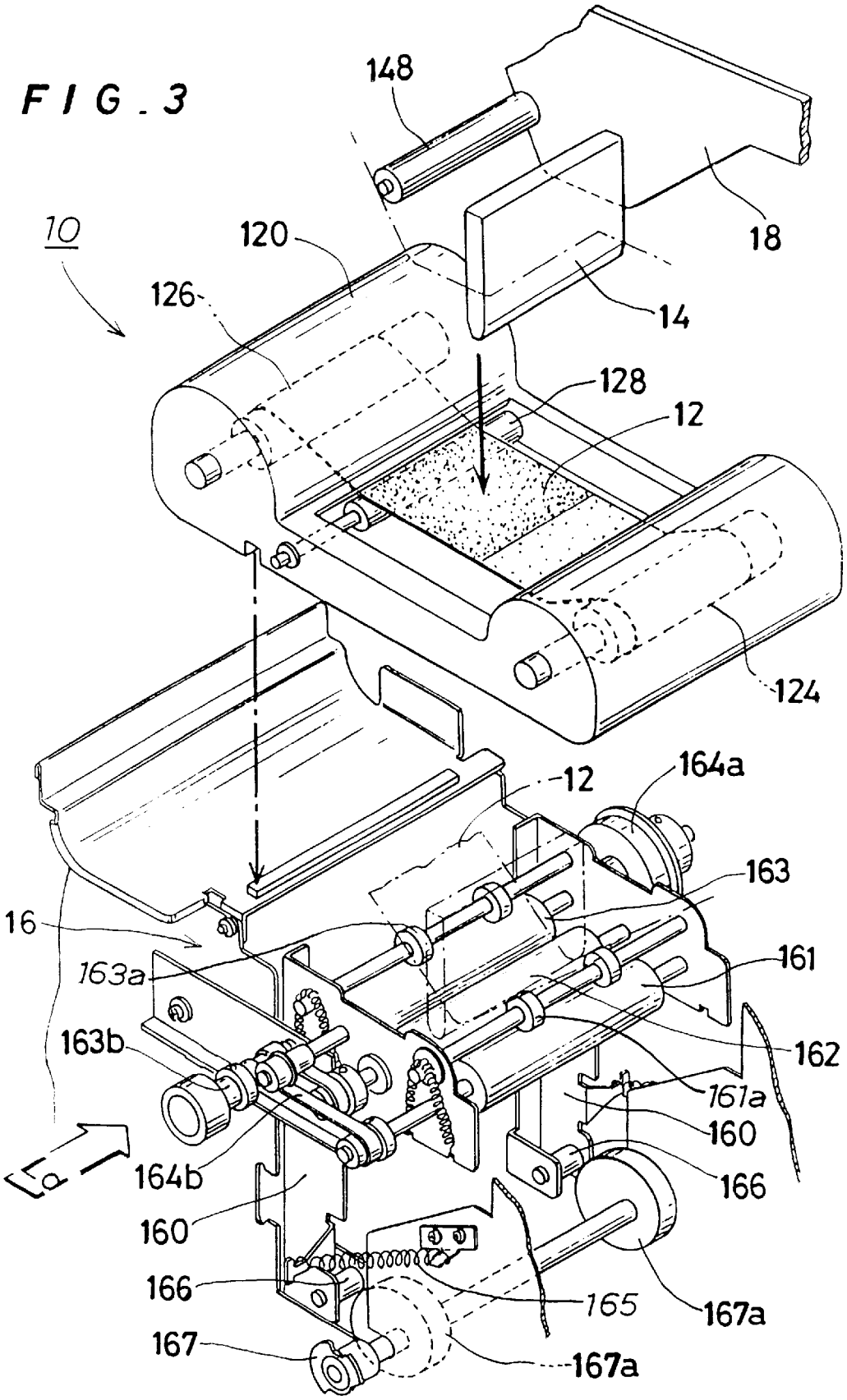
FIG. 3 is an exploded perspective view of one of printing assemblies in the system of this invention.

The first printing assembly 10 representatively illustrated in FIG. 3 is substantially identical with the second printing assembly 20.

The first printing assembly 10 has first driving means including an entry-side capstan roller 161, a platen roller 162, and an exit-side capstan roller 163. The capstan rollers 161 and 163 are in contact with pinch rollers 161*a* and 163*b*, respectively.

The capstan roller 163 is retained by a rotary shaft 163*b* rotated by a drive means 164*a*. The rotation of the rotary shaft 163*b* is transmitted to the rollers 161 and 162 through transmitting means 164*b* so as to synchronously rotate the rollers 161 to 163. The drive means 164*a* includes a pulse motor capable of minutely determining its rotational quantity in accordance with the number of current pulses supplied thereto, thus severely controlling the movement of the card C with a high accuracy.

The rollers 161, 162 and 163 correspond to rollers 261, 262 and 263 of second driving means in the second printing assembly 20.

The rollers 161, 161*a*, 162, 163 and 163*a* are supported by a substantially L-shaped rocking arm 160 having a horizontal portion and a vertical portion. The rocking arm 160 is constantly urged by a spring 165 so as to force up the horizontal portion. The rocking arm 160 is provided at the lower end of the vertical portion with a cam follower 166. Opposite to the cam follower 166, there is disposed an elliptic cam 167*a* united with an angle detection plate 167*b*, so that the horizontal portion of the rocking arm 160 is rockingly moved around the rotary shaft 163*a* with the rotation of the elliptic cam 167*a*.

The spring 165, cam follower 166, cam 167*a* and angle detection plate 167*b* correspond to elements 265, 266, 267*a* and 267*b* in the second printing assembly 20.

The angle detection plate 167*b* has notches which activate and deactivate sensors 167*c* and 167*d* to perceive the rotational posture of the cam 167*a*.

The run-off angle of the first ink ribbon 12 is determined by a guide roller 128 in conjunction with a guide roller 148 held by the cover lid 18. As was touched on briefly earlier, since the second printing assembly 20 substantially corresponds to the first printing assembly 10, the run-off angle of the second ink ribbon 22 is determined by a guide roller 228 in contact with a guide roller 248 in the second printing assembly 20.

Figure 4A:
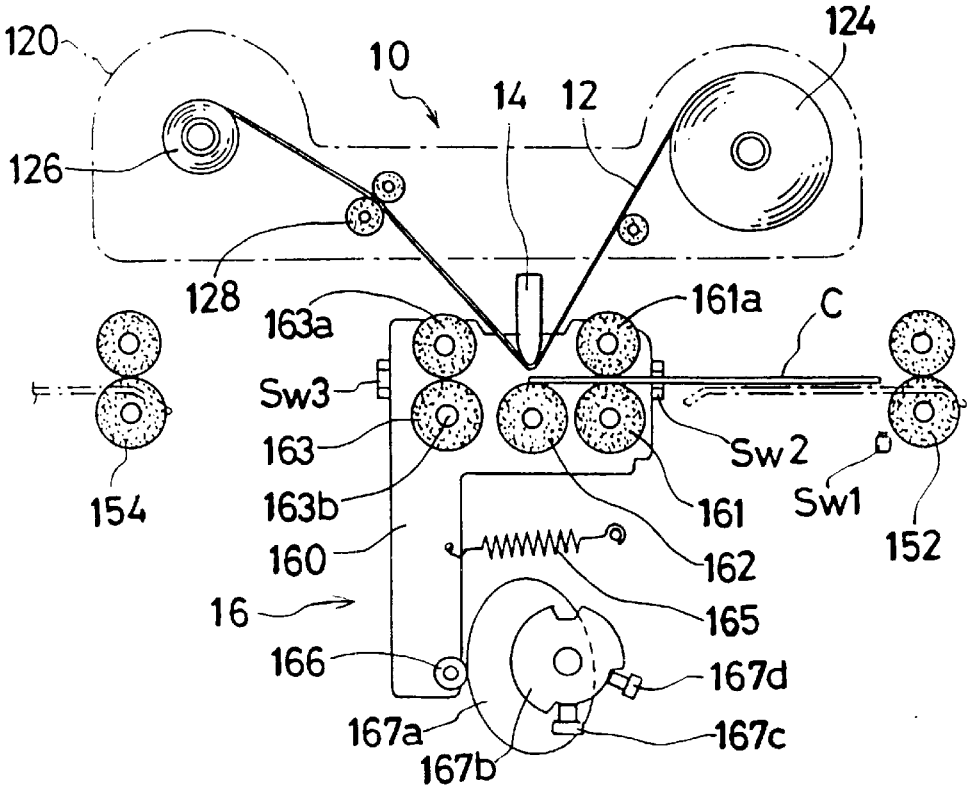
FIGS. 4(A) and 4(B) are explanatory views showing the operation of the system of this invention.

Along the card feed passage W, there are arranged two pair of transport rollers 152 and 154 (corresponding to rollers 252 and 254 in the second printing assembly 20), and card sensors Sw1, Sw2 and Sw3 as shown in FIG. 4(A).

Figure 4B:
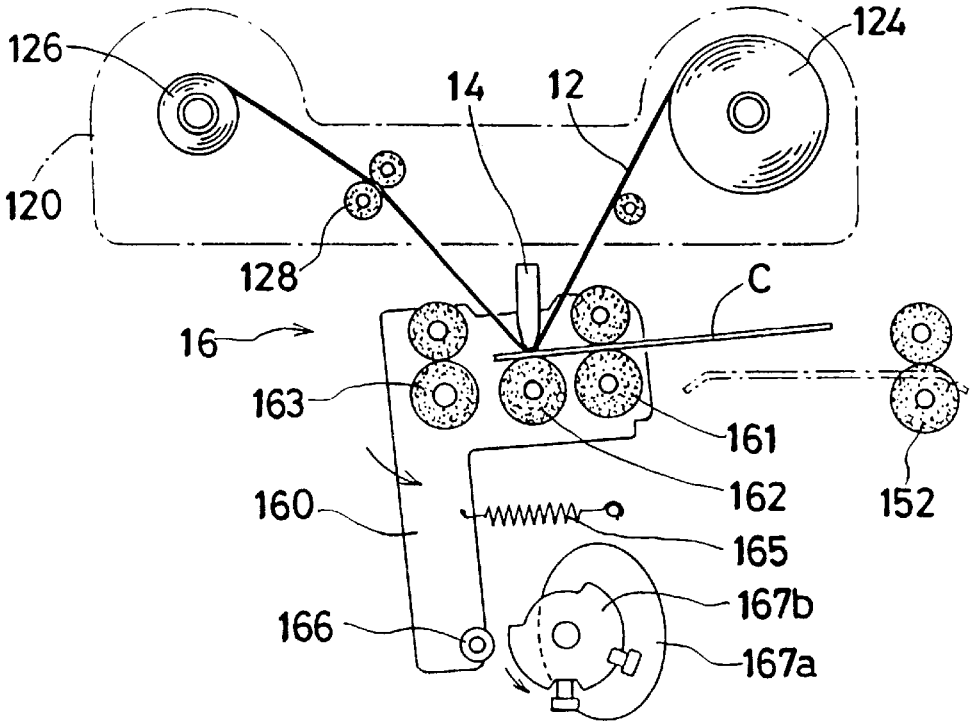
Figure 5:
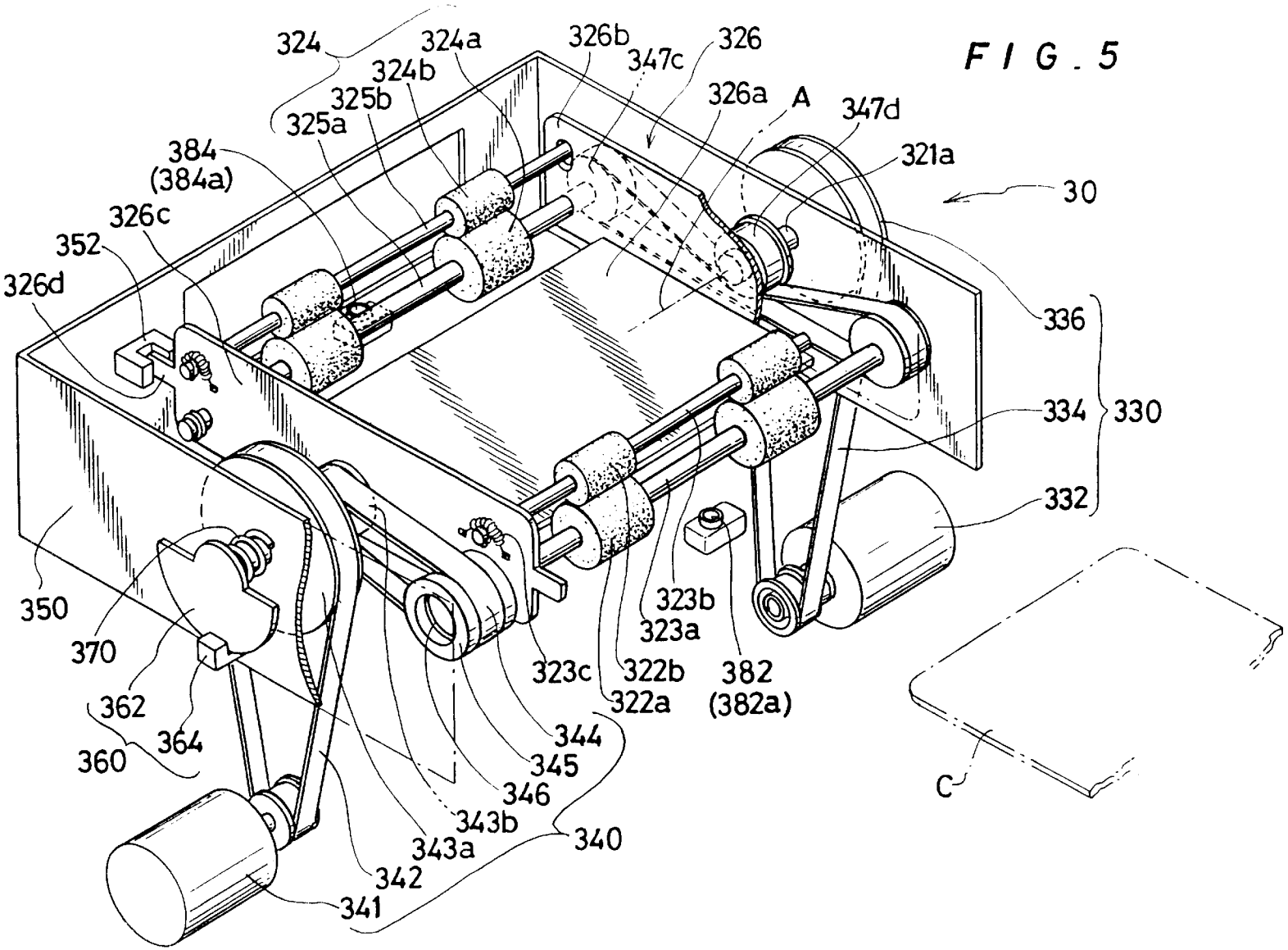
FIG. 5 is a schematic perspective view of a card turning section of this invention.

When the front end of a printing area prescribed on the card C arrives at the printing point at which the thermal print head 14 faces the platen roller 162 in the state shown in FIG. 4(A), the cam 167*a* rotates to force the horizontal portion of the rocking arm 160 upward to bring the card into contact with the print head 14 through the ink ribbon 12 as shown in FIG. 4(B). Then, the card C is forwarded together with the ink ribbon 12 by rotating the rollers 161, 162 and 163 while being kept in contact with the print head 14 and driving the print head 14 to heat. As a result, the ink on the ink ribbon 12 is thermally transferred to the card C, thus producing the desired image pattern on the card. Upon completion of printing with one of color inks, the cam 167*a* rotates so as to lower the horizontal portion of the rocking arm 160, thereby separating the card from the print head 14. Then, the rollers 161, 162 and 163 are reversed in rotation to return the card to the status quo ante as shown in FIG. 4(A). The same procedure is repeated three times equal to the number of colors to be printed.

The accurate positioning of the card C at the printing point can be attained by starting taking count of pulses of the driving current supplied to the pulse motor when the leading end of the card being reversed is detected by the card sensor Sw3. Thus, continuous full-color tone (multiple gradation) images without suffering color draft can be printed on the card C.

Similarly to the printing procedure in the first printing assembly 10 as specified above, binary gradation images (black-and-white images) such as characters and bar code patterns is printed on the same card with the black thermal wax-transfer ink 22*a*, and further, the card thus printed is finally coated with the protective layer 22*b* in the second printing assembly 20.

In this embodiment, the cartridges 120 and 220 accommodating the ink ribbons 12 and 22 are put into the printing parts 16 and 26 in the respective printing assemblies 10 and 20, whereas the method for putting the. cartridges 120 and 220 into the printing parts 16 and 26 is by no means limitative, and the cartridges may be placed at the printing parts 16 and 26 in any manner. As shown by the arrow Ld in FIG. 3 by way of example, the cartridge 120 may be inserted from the front side of the printing assembly 10 into the printing part 16. Of course, the same are true for the printing assembly 20.

With the printer section $P_{RT}$ having the components as described above, the card having the obverse side printed with the desired binary gradation and/or multiple gradation images can be effectively produced, and then, it is sent out to the turning section 30 along the card feed passage W.

The card C fed from the printer section $P_{HT}$ is turned over 180° at the turning section 30 and sent back to the printer section $P_{RT}$ to perform printing on the reverse side of the card.

The card turning section 30 comprises a rotary body 320 rotatable on its own axis (turning axis A), which is provided with roller units 322 and 324, means 330 for turning the rotary body 320 on the axis A, and card feed means 340 for driving at least one of the roller units 322 and 324.

The rotary body 320 has axial rotation shafts 321*a* and 321*b* supported rotatably on a support base 350 so as to be rotated on the axis A by driving the turning means 330.

The rotary body 320 is formed substantially of a frame 326 constituted by a horizontal beam 326*a* provided at its both side ends with side walls 326*b* and 326*c* between which the aforesaid roller units 322 and 324 are retained.

The turning section 18 incorporates a position sensor 352 for detecting the position of the rotary body 320, which is constituted by a photo interrupter generally formed of a light-emitting element and a photo-detector for detecting marking tags 326*d* protruding horizontally from both ends of the side wall 326*c*. With the position sensor 352, the prescribed horizontal posture of the rotary body 320 can be discerned.

The roller units 322 and 324 are supported by the frame 326 and symetric with respect to the turning axis A. The roller units 322 and 324 respectively have paired rollers 322*a*–322*b* and 324*a*–324*b* which come in contact with each other in pairs on the card feed passage W passing through the axis A. The paired rollers 322*a*, 322*b*, 324*a* and 324*b* are retained by rotation shafts 323*a*, 323*b*, 325*a* and 325*b*, respectively. Although the rotation shafts each have two rollers in the illustrated embodiment, the number of such rollers per shaft is by no means limitative. One or more rollers may be disposed on one shaft.

The rollers 322*a* and 324*a* of the aforenoted paired rollers are drive rollers integrally rotatable with the driving rotation shafts 323*a* and 324*a*. The rollers 322*b* and 324*b* are idle rollers freely rotatable, but urged toward the rollers 322*a* and 324*a* by spring means 323*c* so as to bring the idle rollers 322*b* and 324*b* into press contact with the driving rollers 322*a* and 324*a*, respectively. Thus, the idle rollers 322*b* and 324*b* rotate together with the driving rollers 322*a* and 324*a*, thereby moving the card C held therebetween.

The turning means 330 for turning the rotary body 320 around the turning axis A comprises a turnover motor 332, a transmission means 334, and a turnover pulley 336 secured on the shaft 321*a* and connected to the turnover motor 332 via the transmission means 334.

The turnover motor 332 may be of any type insofar as it can produce rotation in at least one direction and be precisely controlled in its rotational angle. Although a pulse motor can be preferably used, a combination of a DC motor and a rotation controller may be applied instead.

In the illustrated embodiment, as the transmission means 334, an endless belt is used, but may of course be any mechanism such as a gear system and a crank.

The card feed means 340 for driving the roller unit 322 in this embodiment comprises a card feeding motor 341, a stationary-side transmission means 342, axial pulleys 343*a* and 343*b*, a turnover-side transmission means 344, a feeding pulley 345 secured on at least one of the shafts, 323*a*, and a rotation switch means 346 for allowing rotation in one direction from the card feeding motor 341 to be transmitted to the aforenoted shaft 323*a*.

Figure 8A:
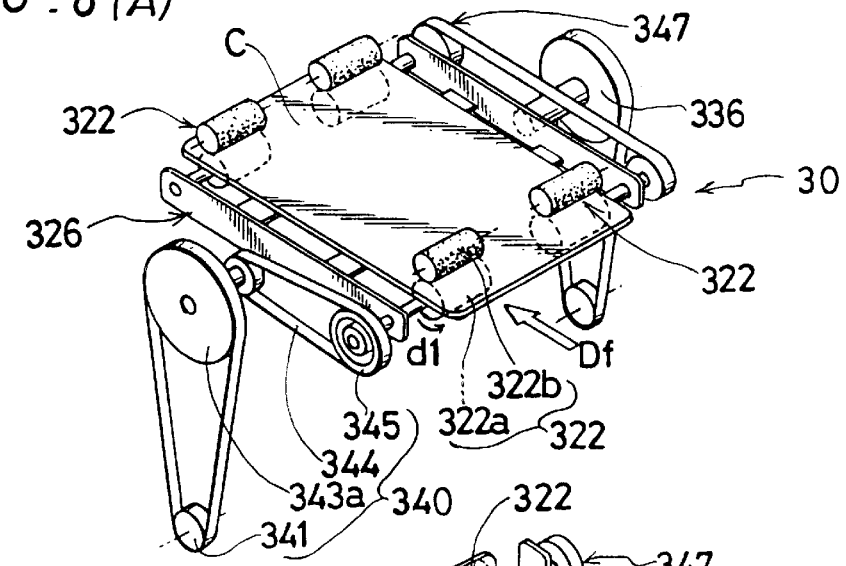
FIGS. 8(A) through 8C are views explanatory of the operation of the card turning section of this invention.

Similarly to the turnover motor 332, the card feeding motor 341 may be of any type insofar as it can rotate the rollers 322*a* and 324*a* in one direction (card feeding direction d1 as shown in FIG. 8(A)) and be precisely controlled in rotational angle. As the card feeding motor 341, a pulse motor or a combination of a DC motor and a rotation controller may be used.

In this embodiment, the transmission means 342 and 344 are endless belts, whereas they may be any mechanism such as a gear system and a crank.

The axial pulleys 343*a*, 343*b* are rotatable independent of the shaft 321*b* connected to the side wall 326*b*. The pulleys 343*a* and 343*b* in this embodiment are formed in substantially one body and have different diameters, but they may of course be equal in diameter.

The rotation switch means 346 in this embodiment is a one-way clutch and assembled in the feeding pulley 345. That is, the one-way clutch 346 may have an outer ring holding the transmission means (belt) 344 and an inner ring fixed on the shaft 323*a*.

Accordingly, when the card feeding motor 341 is driven to rotate the pulleys 343*a* and 343*b* in the card feeding direction d1, the rollers 322*a* and 324*a* rotate in the same direction, thus forwarding the card C as shown in FIG. 2. However, if the motor 341 is reversed to rotate in the opposite direction to d1, the rollers 322*a* and 324*a* do not rotate because the one-way clutch 346 incorporated in the feeding pulley 345 is brought into a disengaged state when the feeding pulley 345 rotates in the opposite direction to the direction d1.

The rotational motion produced by the card feeding motor 341, which is transmitted to the shaft 323*a* via the transmission means 342, feeding pulleys 343*a* and 343*b*, transmission means 344 and pulley 345, is further transmitted from the shaft 323*a* to the shaft 325*a* via a rotation transmission system 347 including a pulley 347*a* attached to the shaft 325*a*, a belt 347*b* and a pulley 347*c*.

Denoted by 347*d* is a tension roller 347*b* for exerting tension to the belt 347*b*, but this roller is not absolutely necessary to this invention.

In the illustrated embodiment mentioned above, the rotational motion is given to the rotation shaft 325*a* through the rotation transmission system 347 including the pulley 347*a*, belt 347*b* and pulley 347*c*, whereas the rotation shaft 325*a* may be driven directly by the pulley 343*b*. In this case, the rotation transmission system 347 is not required.

On the axial shaft 321*b* extending laterally from the side wall 326*b* of the frame 326, there is mounted a card face detector 360 for perceiving the surface of the card C, which is generally formed of a semicircular index plate 362 attached to the shaft 321*b* and an index sensor 364 such as a photo interrupter fixed on the support base 350.

A spring 370 disposed between the index plate 362 and the support base 350 serves to impart a thrust force to the frame 326, so as to prevent wobbling of the frame 326.

Figure 6:
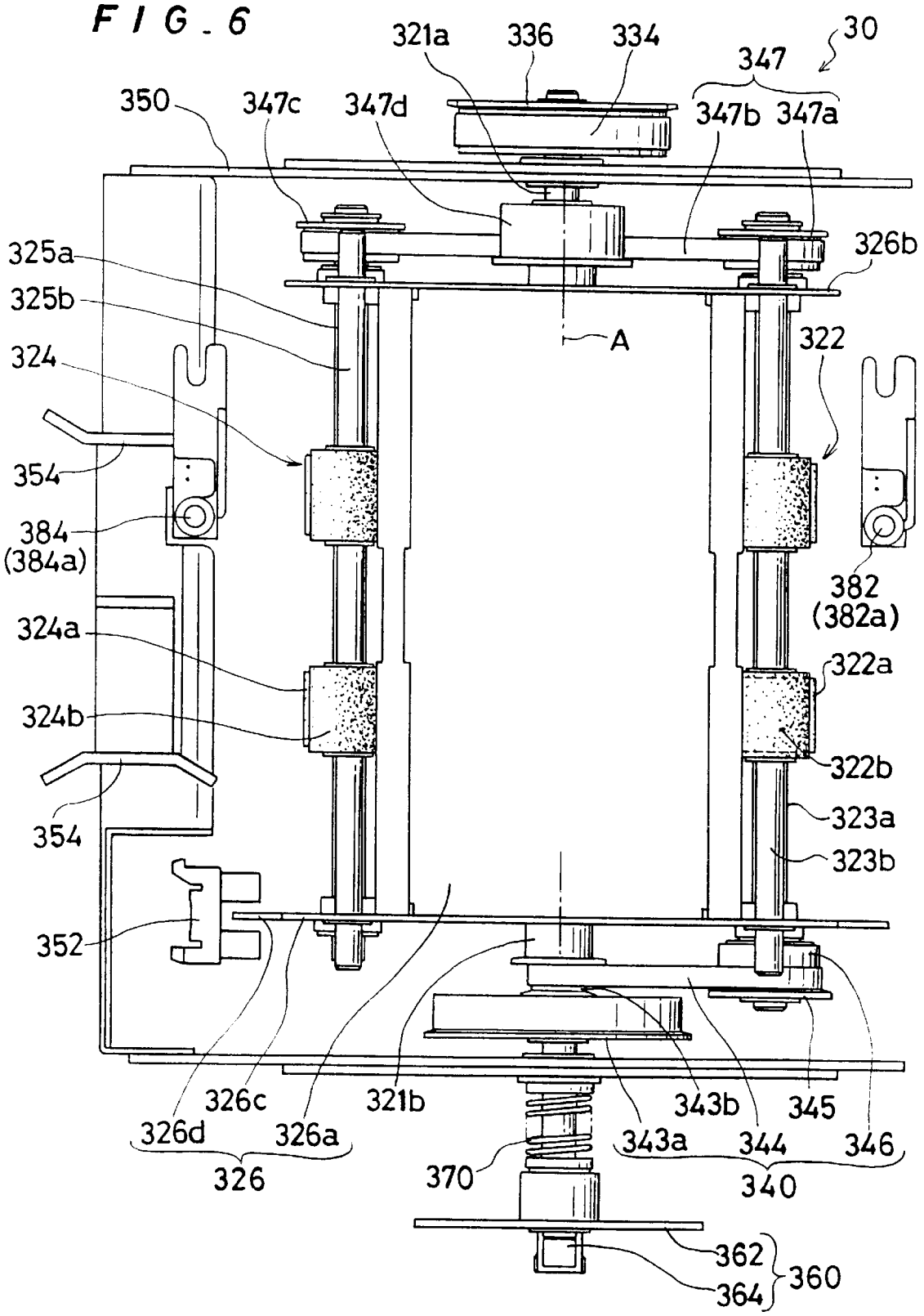
FIG. 6 is a plan view of the card turning section of this invention.
Figure 7:
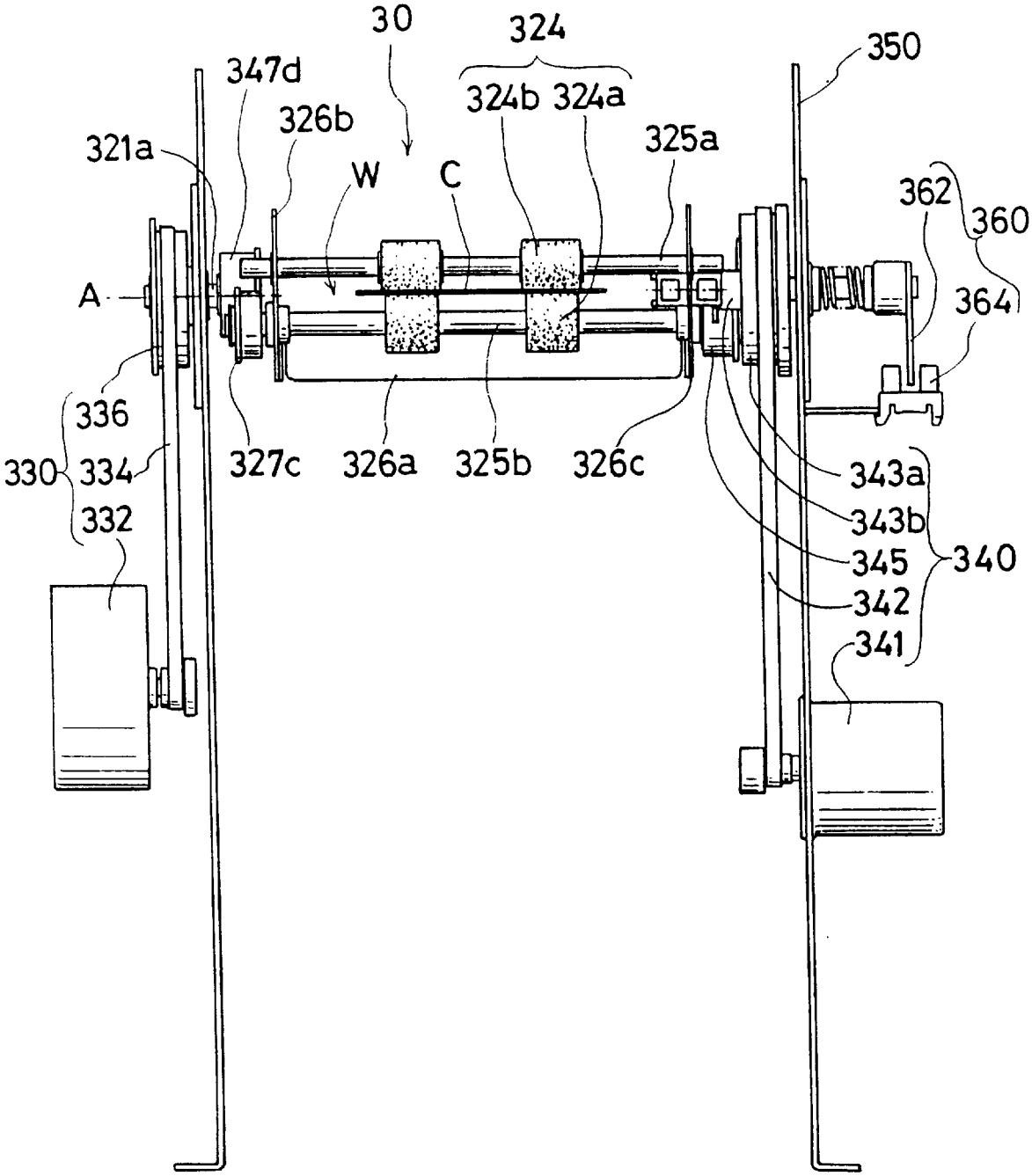
FIG. 7 is a left side view of FIG. 6.

In the illustrated embodiment, guide members 354 are disposed on the card exit side of the turning section 30 as shown in FIG. 6, whereas like guide members may be added to the card entrance side of the turning section as occasion calls.

Furthermore, on the card entrance and exit sides, there are disposed card sensors 382 and 384 formed of light-emitting elements 382*a*, 384*a*, and photo detectors 382*b*, 384*b*, respectively. With these card sensors 382 and 384, the card C can be recognized with high accuracy and moved with exquisite timing.

Next, the operation of the card turning section 30 of this invention will be explained below, particularly referring to FIG. 2 and FIGS. 8(A) to 8(C), to reveal the effect of preventing displacement of the card when turning over the card.

As shown in FIG. 2, when the card C is fed in the direction Df from the printer $P_{RT}$ upon completion of printing on the obverse side of the card, the card feeding motor 341 starts to rotate the pulleys 343*a*, 343*b* and 345 to move the card C in the forwarding direction Df. At this time, the one-way clutch (rotation switch means) 346 assumes its engaged state to permit the rotational motion produced by the motor 341 to be transmitted to the shaft 323*a*, consequently to rotate the rollers 322*a* and 322*b* in the card feeding direction. The rotational motion is further transmitted to the shaft 325*a* through the rotation transmission system 347, thus simultaneously rotating the rollers 324*a* and 324*b* in the card feeding direction.

When the card C from the printer $P_{RT}$ is fed into between the rotating rollers 322*a* and 322*b*, it is forwarded by the rollers 322*a* and 322*b* as illustrated in FIG. 8(A), and then, when the card C reaches the prescribed turning position defined at the substantial center of the frame 326, the card feeding motor 341 is stopped to bring the card C to a standstill there.

Figure 8B:
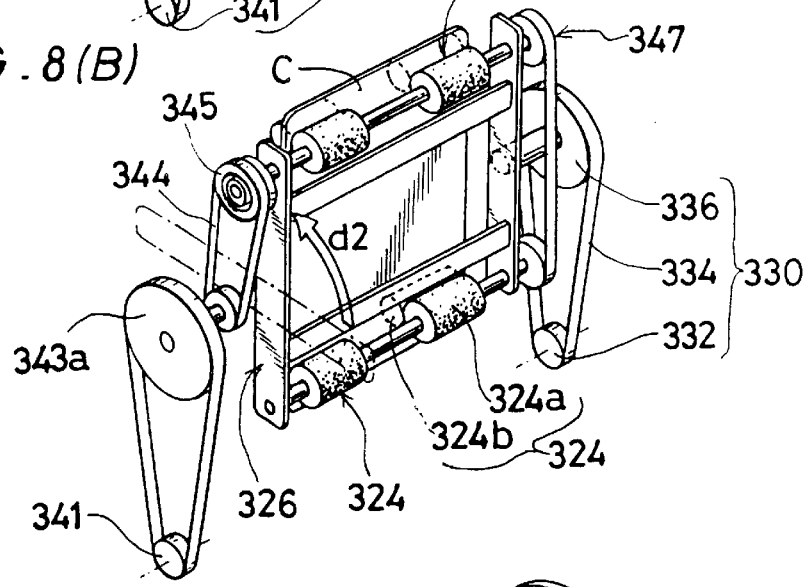

Next, the turnover motor 332 is driven to rotate the turnover pulley 336 in the turning direction d2 same as the direction d1 as shown in FIG. 8(B). Since the pulleys 343*a* and 343*b* are stopped at this time, the belt 344 wound round the pulley 343*b* moves by a part of a circumferential length of the pulley 343*b*, which corresponds to the angle at which the rotary body 320 revolves. As a result, the feeding pulley 345 rotates relative to the rotary body 320 in the opposite direction to the feeding direction d1.

If the feeding pulley 345 is connected with the shaft 323*a* at this time, the rollers 322*a* and 324*a* should rotate in the opposite direction to the direction d1, thus displacing the card C from the prescribed proper turning position. However, since the one-way clutch 346 in the feeding pulley 345 is brought into a disengaged state when the feeding pulley 345 rotates in the opposite direction to the card feeding direction d1 as touched upon above, the shaft 323*a* does not rotate, so that the card C does not move relative to the rotary body 320.

Figure 8C:
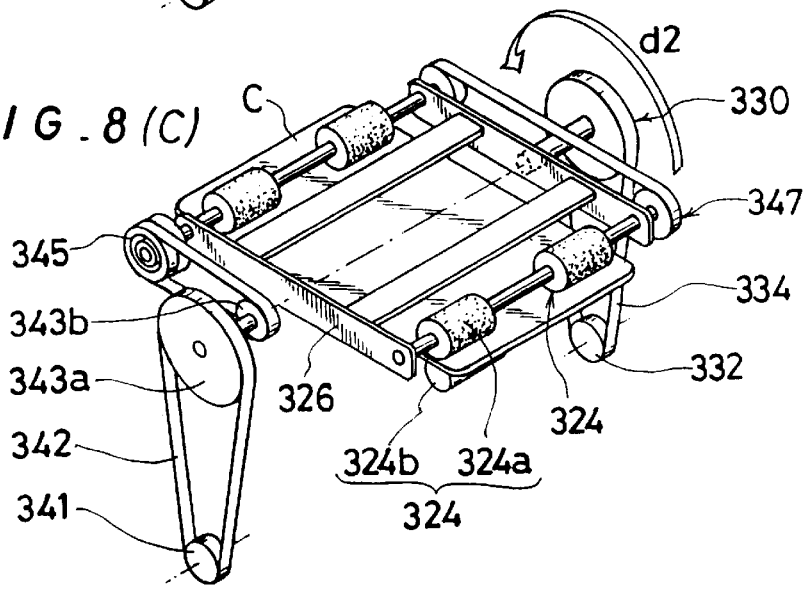

Thus, the card C is turned over 180° without moving relative to the rotary body 20 as shown in FIG. 8(C). Therefore, the card C does not come off or fall from the prescribed turning position in the rotary body 320.

The one-way clutch having the outer and inner rings between which needle rollers are interposed is used as the rotation switch means 346 in the foregoing embodiment, whereas this invention does not contemplate imposing any limitation on the structure of the rotation switch means. To be more specific, an electromagnetic clutch may be assembled in the card turning section 30 as the rotation switch means.

With the electromagnetic clutch disposed on the rotation transmission route from the feed motor 341 to the shaft 323*a*, the desired controlling of the rotational direction of the rotary body 320 can easily be carried out, so that the rollers 322*a* and 324*a* do not rotate when the rotary body 320 revolves on the axis A. According to the turning section of this embodiment, the card fed from the printer section can be turned over without being displaced and sent back the inverted card to the printer section, thereby to perform printing on both sides of the card with high efficiency. In the illustrated embodiment, the printer section $P_{RT}$ and the turning section 30 are integrally connected, but are not necessarily united. The turning section 30 may of course be united separably from the printer section 30 including the card supply unit 40. The turning section 30 separated from the printer section $P_{RT}$ may be applied for the other existing card printers.

As is apparent from the foregoing description, according to the present invention, high-quality photo-realistic full-color images and binary gradation monochrome images such as characters and bar code patterns can be effectively produced on both sides of various card such as an identity card and credit card by use of the dye-sublimation ink ribbon and the thermal wax-transfer ink ribbon accommodated in the respective printing assemblies. Thus, the transfer inks can be used without waste because two kinds of images are separately printed by the relevant inks. The printing system of this invention has only one printer section incorporating the printing assemblies for performing one-side printing, whereas the desired images can be effectively printed on not only the obverse side of the card, but also the reverse side of the same card with only one printer section for one side printing by means of the turning section capable of turning over the card.

Thus, the present invention can provide the excellent double-side printing system capable of printing desired images on both sides of the card by use of one-side printing means in a rational manner.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. A double-side printing system comprising:

a printer section having a first printing assembly for printing first images with a first ink ribbon on a record medium, and a second printing assembly for printing second images on the record medium with a second ink ribbon; and a turning section for turning over the record medium sent out from said printer section and sending back the record medium to said printer section wherein said turning section comprises a rotary body rotatable on a turning axis, said rotary body including roller units with feed rollers being in contact in pairs on said feed passage; a feed means including at least one axial pulley disposed on said turning axis for transmitting rotational motion produced by said feed means to at least one of said feed rollers to move the record medium held between said feed rollers; means for turning said rotary body; and a rotation switch means for selectively transmitting the rotational motion of said feed means to said at least one feed roller.

2. A printing system according to claim 1, wherein said first and second ink ribbons are thermal transfer ink ribbons.

3. A printing system according to claim 1, wherein said first ink ribbon is a dye-sublimation ink ribbon, and said second ink ribbon is a thermal wax-transfer ink ribbon.

4. A printing system according to claim 1, wherein said first ink ribbon is formed by applying dye-sublimation color inks respectively to frames defined on a strip of ribbon base.

5. A printing system according to claim 4, wherein said second ink ribbon is formed by applying thermal wax-transfer ink to a strip of ribbon base.

6. A printing system according to claim 4, wherein said second ink ribbon is formed by alternatively applying thermal wax-transfer ink and transparent protective layer to a strip of ribbon base.

7. A printing system according to claim 1, wherein said second ink ribbon is formed by applying thermal wax-transfer ink to a strip of ribbon base.

8. A printing system according to claim 1, wherein said second ink ribbon is formed by alternatively applying thermal wax-transfer ink and transparent protective layer to a strip of ribbon base.

9. A double-side printing system comprising:

a printer section having a feed passage along which a record medium is fed, a first printing assembly for printing multiple gradation images with dye-sublimation color inks on one side of the record medium, and a second printing assembly for printing binary gradation images on said one side of said record medium with monochromatic thermal wax-transfer ink, said first and second printing assemblies being placed on one side of said feed passage; and a turning section for turning over the record medium sent out from said printer section and sending back the record medium to said printer section wherein said turning section comprises a rotary body rotatable on a turning axis, said rotary body including roller units with feed rollers being in contact in pairs on said feed passage; a feed means including at least one axial pulley disposed on said turning axis for transmitting rotational motion Produced by said feed means to at least one of said feed rollers to move the record medium held between said feed rollers; means for turning said rotary body; and a rotation switch means for selectively transmitting the rotational motion of said feed means to said at least one feed roller.

10. A printing system according to claim 9, wherein said printer section and said turning section are integrally connected.

11. A printing system according to claim 9, wherein said printer section and said turning section are united separably from each other.

12. A printing system according to claim 9, wherein said feed means further includes a feeding motor, a stationary-side transmission means for connecting said feeding motor to said axial pulley, a feeding pulley secured on a rotation shaft on which at least one of said rollers is supported, said feeding pulley incorporating said rotation switch means, and a turnover-side transmission means for connecting said axial pulley to said feeding pulley.

13. A printing system according to claim 9, further comprising a supply unit for storing blank record mediums and sending out said blank record mediums one by one to said first printing assembly through said feed passage.

14. A printing system according to claim 9, wherein said record medium is a card.

15. A double side printing system comprising:

a printer section having a feed passage along which a record medium is fed, a printing assembly including an ink ribbon coated with dye-sublimation color inks and/or a transparent protective layer and a thermal print head for thermally printing multiple gradation images with dye-sublimation color inks on the record medium and thermally transferring said transparent protective layer onto said record medium; and a turning section for turning over the record medium sent out from said printer section and sending back the record medium to said printer section, said turning section including a rotary body having roller units with feed rollers being in contact in pairs on said feed passage; a feed means including at least one axial pulley disposed on said turning axis for transmitting rotational motion produced by said feed means to at least one of said feed rollers to move the record medium held between said feed rollers; means for turning said rotary body; and a rotation switch means for selectively transmitting the rotational motion of said feed means to said at least one feed roller.

* * * * *